US005915328A

United States Patent [19]

Rowan

[11] Patent Number: 5,915,328

[45] Date of Patent: Jun. 29, 1999

[54] BOAT HULL

[75] Inventor: Philip Ewen Rowan, Victoria, Australia

[73] Assignees: Rosalie Jean Rowan, Australia; Norpac Services Limited, Singapore

[21] Appl. No.: 08/913,480

[22] PCT Filed: Mar. 11, 1996

[86] PCT No.: PCT/AU96/00130

§ 371 Date: Sep. 15, 1997

§ 102(e) Date: Sep. 15, 1997

[87] PCT Pub. No.: WO96/28339

PCT Pub. Date: Sep. 19, 1996

[30] Foreign Application Priority Data

Mar. 13, 1995 [AU] Australia ..... PN1675
Jan. 29, 1996 [AU] Australia ..... PN7766

[51] Int. Cl.[6] ..... B63B 17/00

[52] U.S. Cl. ..... 114/362; 441/80

[58] Field of Search ..... 114/343, 361, 114/362; 441/80

[56] References Cited

U.S. PATENT DOCUMENTS 5,537,949 7/1996 Blevins et al. ..... 114/362

FOREIGN PATENT DOCUMENTS

| | | |
|---|---|---|
| 6927491 | 7/1991 | Australia . |
| 3128617C1 | 3/1983 | Germany . |
| 60-154989 | 8/1985 | Japan . |
| 4100793 | 4/1992 | Japan . |
| 889693 | 2/1962 | United Kingdom . |
| 2040831 | 4/1980 | United Kingdom . |

*Primary Examiner*—Stephen Avila
*Attorney, Agent, or Firm*—Rothwell, Figg, Ernst & Kurz, p.c.

[57] ABSTRACT

A boat hull having a bow (11), a stern (12), a bottom (14) extending between the bow (11) and stern (12), a deck (15) and a space under the deck (15) between the bow (11), stern (12) and bottom (14) which provides buoyancy for the hull, the space above the deck (15) being bounded by bulwarks (16) which surround the deck (15), at least one panel (18) located to one side of the hull which is hingedly supported about an axis (19) substantially parallel with the deck (15) to be movable between a first position at which the panel (18) forms a portion of the side of the hull and at least a portion of the panel (18) forms a part of a bulwark (16) and a second position at which the panel (18) extends outwardly from the side of the deck (15), and is rigidly retained in the second position, said panel (18) being buoyant.

7 Claims, 3 Drawing Sheets

BOAT HULL

The present application is a U.S. national phase application based on and claiming priority from co-pending application Ser. No. PCT/AU96/00130, filed Mar. 11, 1996.

BACKGROUND OF THE INVENTION

1. Field of the Invention

The present invention relates to boat hulls and in particular relates to boat hulls which can be used for recreational purposes or working purposes.

The invention has application to vessels having a planing or displacement hull and which are intended to be propelled across the surface of the water by any suitable propulsion means which can include a motor driven propeller, a water jet or the wind In particular the invention relates to an improvement to boat hulls which is intended to facilitate access to and from the vessel, out of and into the water respectively, by both personnel and equipment.

2. Description of the Background Art

According to conventional design the gunwale of a boat is spaced some distance from the surface of the water in order to prevent the deck from being flooded when the boat is in motion and/or in rough seas. Therefore when a person such as a diver wishes to enter the water from a boat it is necessary that they jump or fall from the gunwale of the vessel into the water. If a person wishes to enter the water in a controlled manner it is necessary that they do so in a manner which will not cause the boat to tip or capsize. If a person attempts to enter the water by lowering themself over the side of the vessel or attempts to enter the vessel over the side of the vessel there is a very strong likelihood that they will cause the vessel to tip and become unstable. In addition due to the height of the gunwale from the surface of the water it is very difficult for a swimmer and in particular a scuba diver to enter the vessel unaided. Therefore it is usual to provide a platform or ladder at the stern of the vessel which will enable persons to controllably lower themselves into the water from the stern of the vessel and to climb into the vessel from the water without causing the vessel to tip adversely. However, it is generally undesirable to have people in the water at the stern of the vessel due to the presence of the propeller. A further difficulty with conventional hull designs arises in circumstances where access is required of objects which are in the water and which require servicing or lifting into the vessel such as fishing nets, fish traps, craypots, buoys and like articles, since they usually at some time have to be lifted up and over the gunwales. This action can cause injury to the operator and cause the boat to tip or become unstable.

SUMMARY OF THE INVENTION

It is an object of this invention to provide a boat hull which will achieve all of the desired ride characteristics of a conventional boat hull when in motion but when stationary can facilitate access into and from the water without creating undue instability of the vessel.

Accordingly the invention resides in a boat hull having a bow, a stern, a bottom extending between the bow and stern, a deck and a space under the deck between the bow, stern and bottom which provides buoyancy for the hull, the space above the deck being bounded by bulwarks which surround the deck, at least one panel located to one side of the hull which is hingedly supported about an axis substantially parallel with the deck to be movable between a first position at which the panel forms a portion of the side of the hull and at least a portion of the panel forms a part of a bulwark and a second position at which it extends outwardly from the side of the deck, and is rigidly retained in the second position, said panel being buoyant.

According to a preferred feature of this invention the buoyancy of the panel is greater in the region of the gunwale.

According to a further preferred feature of the invention the at least one panel comprises at least one pair of panels where the panels of each pair are supported at opposite sides of the hull in opposed relation to each other.

According to a further feature the hinged connection between the panel and the hull is closely adjacent the deck.

According to a further preferred feature the at least one panel is at least partially immersed in the water when in the second position whereby its outer edge is substantially in the region of the plane of the water line of the vessel.

According to a further preferred feature of the invention a drive means is provided to effect movement between the first and second position and between the second and first position. According to one embodiment the drive means comprises an articulated linkage between the panel and the bulwark and a an extension means capable of activating the linkage to cause said movement of the panel. The extension means can comprise a fluid operated cylinder.

BRIEF DESCRIPTION OF THE DRAWING

The invention will be more fully understood in the light of the following description of one specific embodiment. The description is made with reference to the accompanying drawings of which.

DETAILED DESCRIPTION OF THE INVENTION

Figure 1:
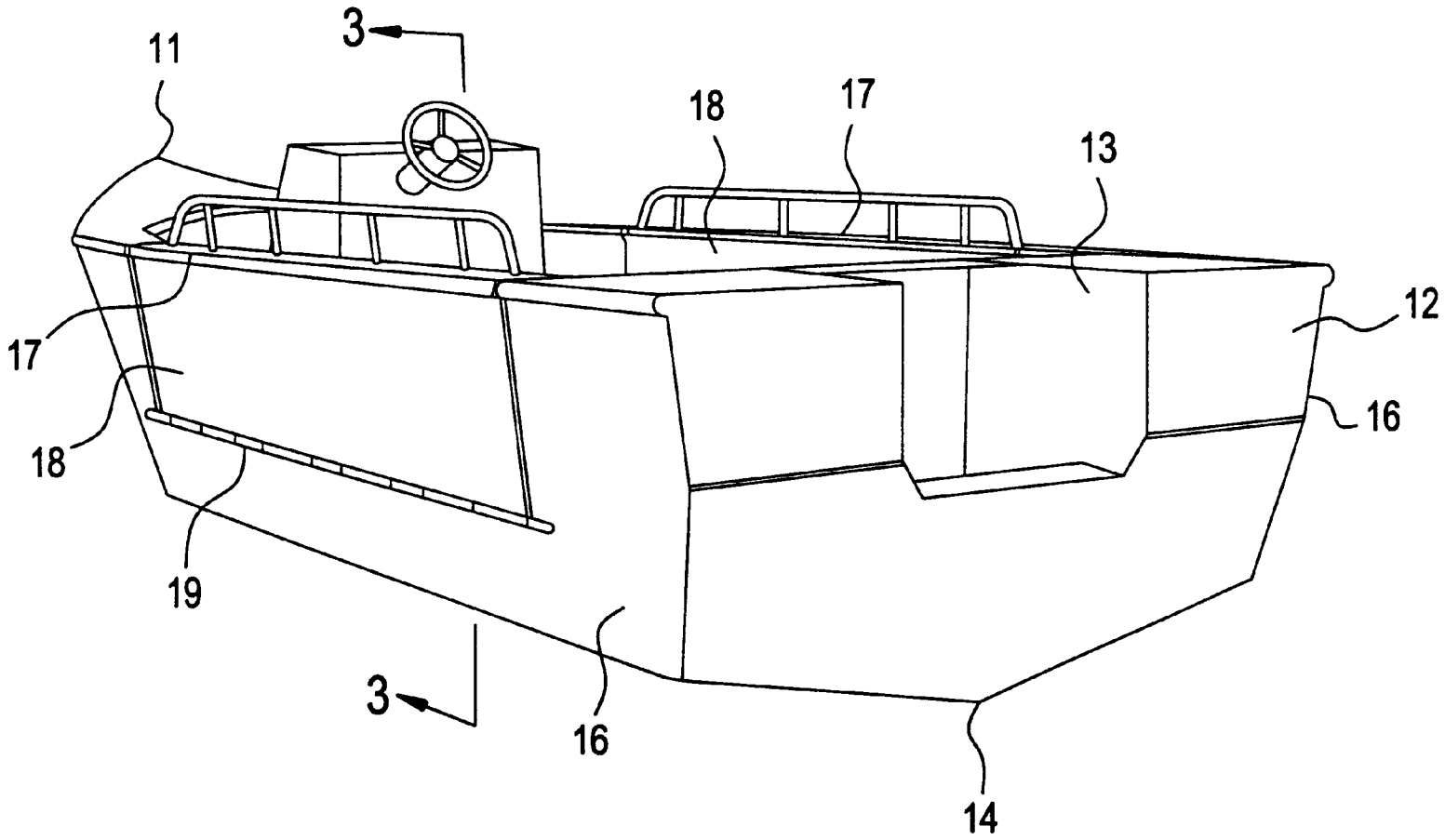
FIG. 1 is a perspective view of a boat hull according to the embodiment showing the side panels in the first position.

The embodiment is directed to a planing boat hull which can be used as a diving boat which whilst on the water, and the design of which facilitates access to and from the vessel by personnel entering the vessel from the water and entering the water from the vessel respectively.

It has been traditional practice in boat hulls of the form shown in the drawings that personnel requiring to leave and enter the vessel must jump from the gunwales of the vessel or lower themselves from over the stern of the vessel so as to not adversely upset the stability of the vessel. In addition because of the height of the gunwales above the water it is usually not possible for persons and in particular divers to climb onto the vessel over its sides. In order to achieve access into the vessel, a platform or ladder must be provided at the stern of the vessel. The difficulty with this arrangement however is that the stern of the vessel will normally accommodate an outboard motor or at least the propeller and there is an inherent danger in having a person swimming in the region of the propeller particularly if the motor is operating.

The present embodiment comprises a planing boat hull which is of a generally conventional configuration comprising a bow 11 a stern 12 which is defined by a transom which is provided with a recess 13 which is able to accommodate an outboard motor. The hull is also provided with a bottom 14 having a profile which is of a generally conventional form in order to provide for the appropriate ride characteristics of the vessel. The interior of the hull is provided with a deck 15 which encloses the space between the bottom of the hull, the bow and the stern and which space provides the buoyancy of the vessel. In accordance with conventional practice the hull is provided with bulwarks 16 at each side of the vessel which extend along each side of the hull between the bow 11 and the stern 12 and which provide a working space above the deck 16 according to conventional practice. The top of the bulwarks constitute the gunwales 17.

Figure 2:
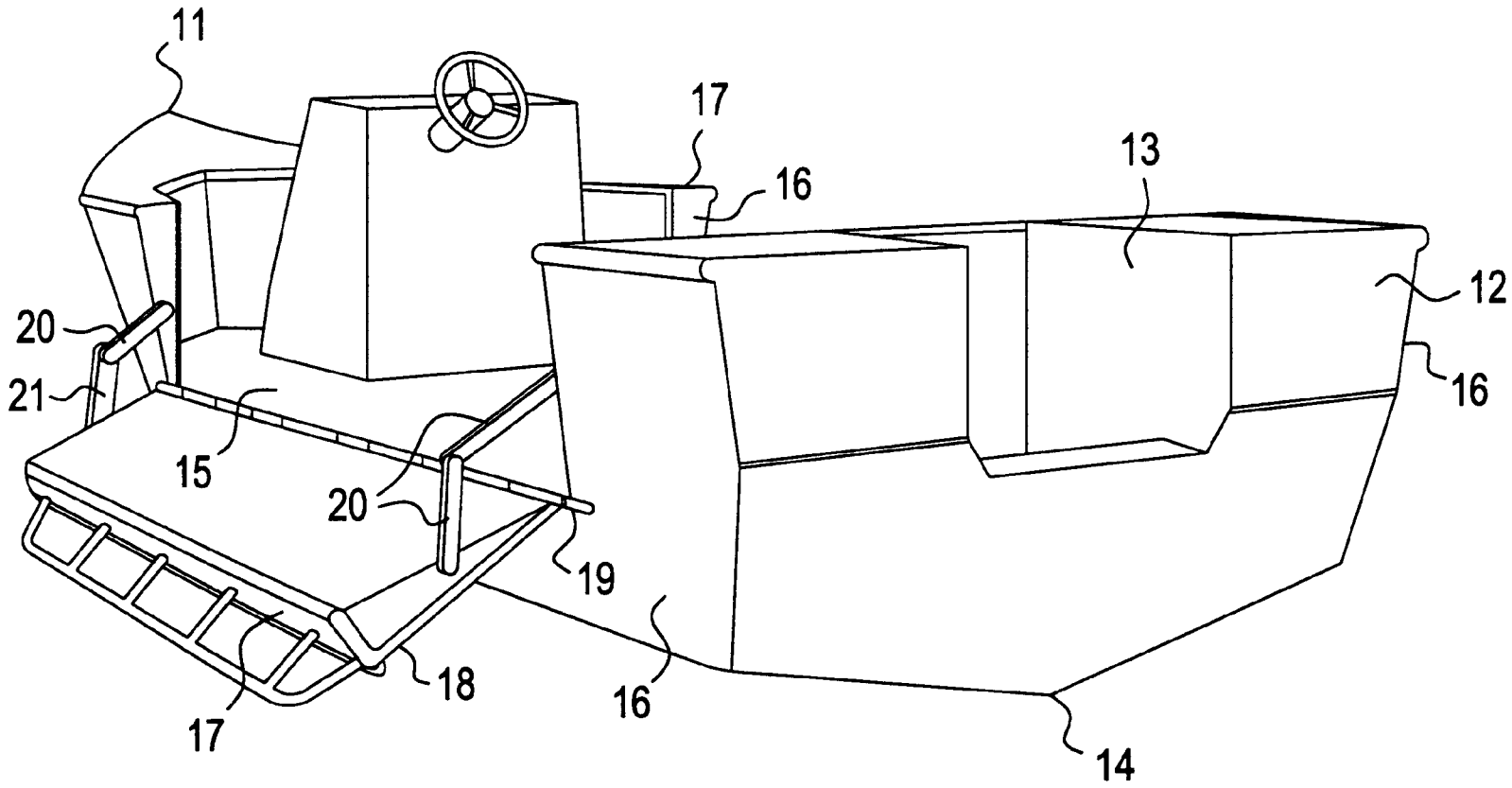
FIG. 2 is an isometric view of the boat hull shown at FIG. 1 with the side panels in the second position.
Figure 3:
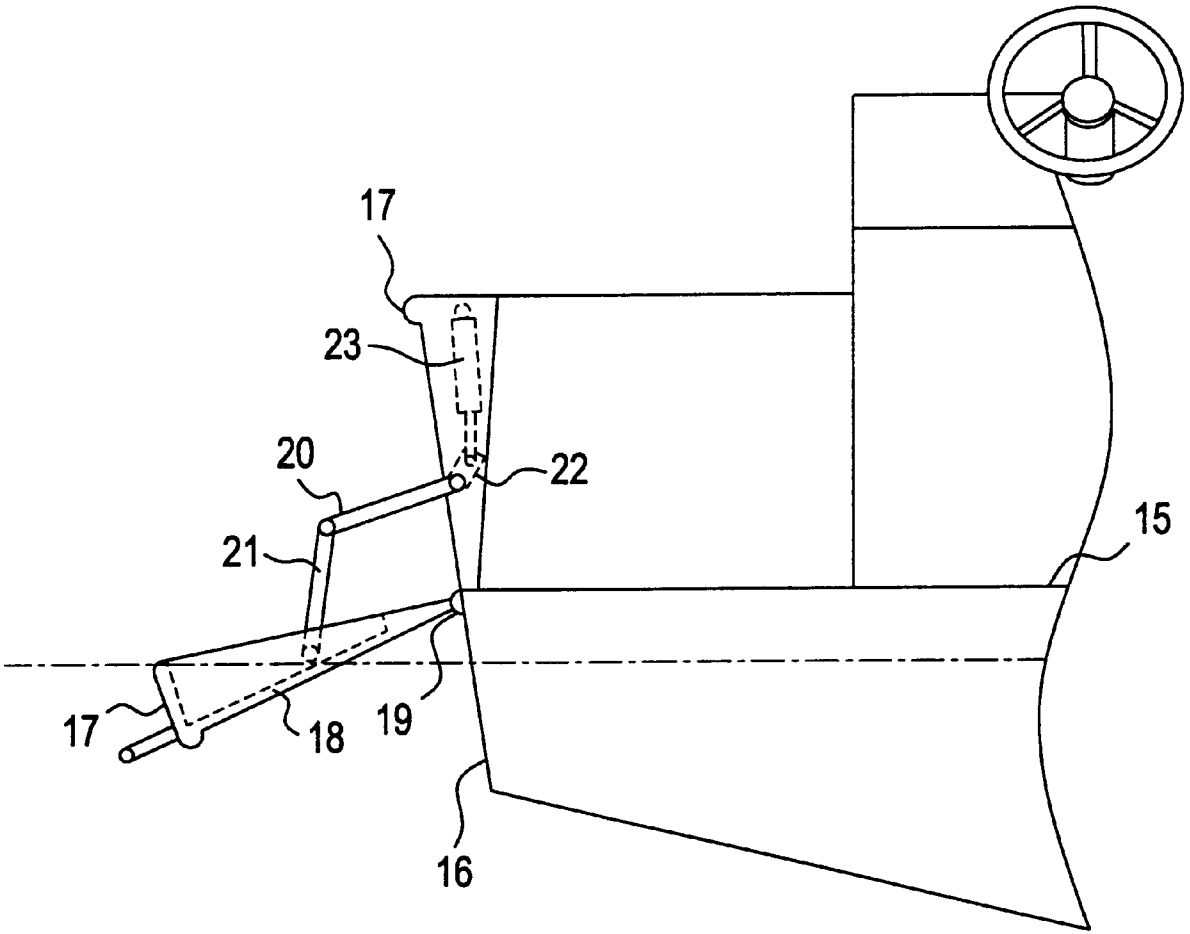
FIG. 3 is a schematic part sectional view of one side of the vessel with the side panels in the second position.

Each bulwark 16 is provided with a panel 18 which forms a portion of the bulwark and which is hingedly mounted by a hinge 19 to the side of the vessel where the hinge is located at the edge of the deck 16. The panel 18 is hollow and is filled with a suitable foam material to ensure buoyancy and the panel is shaped such that the buoyancy of this panel is greater in this region of the gunwale. The panel is further supported by a drive means 19 at each end of the panel which enables movement of the side panel between a first position as shown at FIG. 1 at which position the panel forms a portion of the bulwark 16 of the vessel and a second position as shown at FIGS. 2 and 3, at which position the panel extends outwardly from the side of the vessel to provide an opening through the bulwark.

The drive means comprises an articulated lever mechanism comprises a pair of elongate link members 20 and 21 which are pivotally interconnected end to end, here one link member 20 is pivotally mounted at its free end to the bulwark 16 of the vessel, while the other link member 21 is pivotally mounted at its free end to the end of the panel 18. As shown at FIG. 3 the free end of the one link element 20 is provided with a fixed pivot shaft which extends through a partition in the bulwark to be rotatably received in the partition and whereby the end of the pivot shaft to the other side of the partition is provided with a radial arm 22. The drive means further comprises a hydraulic cylinder 23 mounted between the bulwark and the radial arm, whereby retraction of the hydraulic cylinder causes articulation of the link members 20 and 21 to cause the panel 18 to move from the first position shown at FIG. 1 to the second position shown at FIGS. 2 and 3 and extension of the hydraulic cylinder 23 causes articulation of the link members 20 and 21 to move the panel from the second position to the first position.

When this panel 18 is in the second position the gunwale or outer edge of the panel 18 is located such that it is in general alignment with the waterline of the vessel and when in that position the panel is rigidly held in position by the drive means.

The gunwale 17 of each side panel is provided with an upstanding side rail 22.

The embodiment provides a vessel which has the desired ride characteristics which is required of the vessel when under motion. In addition when stationary the panels 18 may be moved to their second position at which their outer edges or gunwales are immersed in water in the region of the waterline of the vessel where they are held in position by the drive means. As a result the panels 18 serve as buoyant outriggers which provide for improved stability of the vessel when stationary in open water and which render the vessel less sensitive to asymmetric loads. As a result additional loads in the form of additional weight can be applied to the panels 18 when they are in the lowered position without causing the vessel to capsize or develop a dangerous list. A further characteristic of the vessel is that when the panels are in their second position they provide a surface which is at water level whereby personnel are able to easily enter the water from the vessel and climb into the vessel from the water without undue strain. In addition due to the improved stability provided by the panels, such movement of personnel to and from the vessel does not adversely affect the stability of the vessel in the same manner that one would expect of a conventional single hulled vessel and avoids the necessity of personnel having to move to the rear of the vessel in the proximity to the outboard motor in order to climb onto the vessel or controllably leave the vessel. In addition the panels 18 when in their extended position can provide a support platform which can support personnel who are required to manhandle equipment which is being serviced from the vessel such as buoys, crayfishing pots, nets and the like without causing the vessel to capsize or develop a dangerous list.

The embodiment provides a boat hull which can be utilised as a working vessel or a recreational vessel in which the stability of the vessel when stationary in the open water can be enhanced. In addition when the side panels 18 are in the second position the movement of persons or a load to one or the other side of the vessel does not have the same effect as would be the case with a conventional vessel of similar ride characteristics. Furthermore the movement of persons to and fro the vessel from the sides of the vessel when in open water when the side panels are in their second position is more convenient than is the case with conventional vessels. Each of these advantages are achieved without detracting from the desired ride characteristics of the vessel when in motion.

It should be appreciated that the scope of the present invention need not be limited to the particular scope of the embodiment described above and in particular is not restricted to vessels having the hull or ride characteristics of the embodiment.

I claim:

1. A boat hull having a bow, a stern, a bottom extending between the bow and stern, a deck and a space under the deck between the bow, stern and bottom which provides buoyancy for the hull, the space above the deck being bounded by bulwarks which surround the deck, at least one panel located to one side of the hull which is hingedly supported about an axis substantially parallel with the deck to be movable between a first position at which the panel forms a portion of the side of the hull and at least a portion of the panel forms a part of a bulwark and a second position at which it extends outwardly from the side of the deck, to be at least partially immersed in the water and is rigidly retained in the second position, said panel being buoyant wherein the buoyancy of the panel is greater in the region of the gunwale.

2. A boat hull as claimed at claim 1 wherein the at least one panel comprises at least one pair of panels, where the panels of each pair are supported at opposite sides of the hull in opposed relation to each other.

3. A boat hull as claimed at claim 1, wherein the hinged connection between the panel and the hull is closely adjacent the deck.

4. A boat hull as claimed at claim 1, wherein the at least one panel is at least partially immersed in the water when in the second position whereby its outer edge is substantially in the region of the plane of the water line of the vessel.

5. A boat hull as claimed at claim 1, wherein a drive means is provided to effect movement of the panel between the first and second position and between the second and first position.

6. A boat hull as claimed at claim 5 wherein the drive means comprises an articulated linkage between the panel and the bulwark and a an extension means capable of activating the linkage to cause said movement of the panel.

7. A boat hull as claimed at claim 6 wherein the extension means comprises a fluid operated cylinder.

* * * * *